US011631559B2

(12) United States Patent
Muir

(10) Patent No.: US 11,631,559 B2
(45) Date of Patent: Apr. 18, 2023

(54) HYBRID SWITCHING DEVICE AND HYBRID ACTUATOR INCORPORATING SAME

(71) Applicant: Camlin Technologies Limited, Lisburn (GB)

(72) Inventor: Mark Muir, Belfast (GB)

(73) Assignee: Camlin Technologies Limited, Lisburn (GB)

( * ) Notice: Subject to any disclaimer, the term of this patent is extended or adjusted under 35 U.S.C. 154(b) by 291 days.

(21) Appl. No.: 16/635,179

(22) PCT Filed: Jul. 31, 2018

(86) PCT No.: PCT/EP2018/070726
§ 371 (c)(1),
(2) Date: Jan. 30, 2020

(87) PCT Pub. No.: WO2019/025438
PCT Pub. Date: Feb. 7, 2019

(65) Prior Publication Data

US 2021/0090830 A1 Mar. 25, 2021

(30) Foreign Application Priority Data

Jul. 31, 2017 (GB) ..... 1712296

(51) Int. Cl.
*H01H 3/28* (2006.01)
*H01H 33/666* (2006.01)
*H01H 57/00* (2006.01)

(52) U.S. Cl.
CPC ..... *H01H 33/666* (2013.01); *H01H 3/28* (2013.01); *H01H 57/00* (2013.01); *H01H 2057/003* (2013.01)

(58) Field of Classification Search
CPC .. H01H 3/28; H01H 3/22; H01H 3/32; H01H 33/666; H01H 33/662; H01H 33/664;
(Continued)

(56) References Cited

U.S. PATENT DOCUMENTS 2,090,169 A * 8/1937 Gustav ..... H01H 71/68 335/26
4,042,967 A * 8/1977 Yamamoto ..... H02H 3/07 361/45
5,270,984 A 12/1993 Mine
(Continued)

FOREIGN PATENT DOCUMENTS

DE 10017178 A1 10/2001
DE 102015218724 A1 3/2017
(Continued)

OTHER PUBLICATIONS

EP0517049 translation (Original document published Sep. 12, 1992) (Year: 1992).*
(Continued)

*Primary Examiner* — William A Bolton
(74) *Attorney, Agent, or Firm* — Christopher & Weisberg, P.A.

(57) ABSTRACT

A switching device comprising first and second body parts and a first operating device for moving the body parts into a closed state. A piezoelectric actuator is coupled to each body part and is operable to move the body parts part away from one another. The switching device may be incorporated into an actuator for operating the vacuum interrupter of a vacuum circuit breaker.

15 Claims, 4 Drawing Sheets

(58) Field of Classification Search
CPC ..... H01H 57/00; H01H 2057/003; H01H 2057/006; H01H 71/127; H01H 71/32; H01H 35/343
USPC ..... 218/140, 120, 139, 153, 154, 155
See application file for complete search history.

(56) References Cited

U.S. PATENT DOCUMENTS

| | | | | |
|---|---|---|---|---|
| 6,404,108 | B1 * | 6/2002 | Yachi | H01L 41/042 310/316.01 |
| 6,411,009 | B2 * | 6/2002 | Jaenker | H02N 2/043 310/316.01 |
| 6,784,389 | B2 * | 8/2004 | Belanger, Jr | H01H 57/00 200/181 |
| 7,525,783 | B2 * | 4/2009 | Chemisky | F02D 41/2096 361/139 |
| 8,022,578 | B2 * | 9/2011 | Kondo | B41J 2/04515 307/117 |
| 2016/0329182 | A1 | 11/2016 | Graber et al. | |

FOREIGN PATENT DOCUMENTS

| | | | |
|---|---|---|---|
| EP | 0517049 | A1 | 12/1992 |
| EP | 1587122 | A1 | 10/2005 |
| FR | 2970595 | A1 | 7/2012 |
| GB | 2382721 | A | 6/2003 |
| WO | 2015112796 | A1 | 7/2015 |

OTHER PUBLICATIONS

DE10017178 translation (Original document published Oct. 18, 2001) (Year: 2001).*

International Search Report dated Jan. 2, 2019, for corresponding International Application No. PCT/EP2018/070726 filed on Jul. 31, 2018, consisting of 16-pages.

Search Report dated Jan. 17, 2018, for corresponding European Application No. GB1712296.1 filed on Jan. 31, 2017; consisting of 1-page.

* cited by examiner

HYBRID SWITCHING DEVICE AND HYBRID ACTUATOR INCORPORATING SAME

CROSS-REFERENCE TO RELATED APPLICATIONS

This application is a submission under 35 U.S.C. § 371 for U.S. National Stage Patent Application of, and claims priority to, International Application Number PCT/EP2018/070726 entitled HYBRID SWITCHING DEVICE AND HYBRID ACTUATOR INCORPORATING SAME filed Jul. 31, 2018, which is related to and claims priority to Great Britain Application Serial No. 1712296.1, filed Jul. 31, 2017, the entirety of all of which are incorporated herein by reference.

FIELD OF THE INVENTION

The present invention relates to switching devices, especially magnetically operable switching devices. The invention relates particularly to actuators incorporating such switching devices, especially actuators for use with vacuum circuit interrupters and with vacuum circuit breakers.

BACKGROUND TO THE INVENTION

A vacuum circuit breaker (VCB) normally comprises a vacuum circuit interrupter and an actuator for operating the interrupter between open and closed states.

Conventionally, the actuator comprises an electromagnetic device coupled to the contacts of the interrupter by bellows, the electromagnetic actuator and the bellows being located outside of the vacuum enclosure that contains the interrupter. Such VCBs are large, relatively slow to operate and relatively difficult to control precisely. Also, the bellows are prone to failure. The slow speed and low precision control is caused at least in part by the use of electromagnetic actuators. The relatively large size is due in part to the external bellows.

It would be desirable to address the problems outlined above.

SUMMARY OF THE INVENTION

A first aspect of the invention provides a switching device comprising: first and second body parts, at least one of said body parts being movable with respect to the other part; a first operating device coupled to said at least one body part and being operable to move said at least one body part towards said other body part into a closed state; and at least one piezoelectric actuator coupled to either one or both of said body parts and being operable to move said at least one body part away from said other body part out of said closed state.

In preferred embodiments said first and second body parts each has a contact face, the respective contact faces being engaged with one another in said closed state, said at least one piezoelectric actuator being operable to move said at least one body part to cause said contact faces to disengage.

Said first and second body parts may be magnetised or magnetisable to create a magnetic latching effect to hold said body parts in said closed state, and wherein said at least one piezoelectric actuator is operable to move said at least one body part away from the other body part to break said magnetic latching effect. Said first and second body parts may be magnetised or magnetisable to create a magnetic latching effect to hold said contact faces in engagement, and wherein said at least one piezoelectric actuator is operable to move said at least one body part to cause said contact faces to disengage such that said magnetic latching effect is broken.

In preferred embodiments said first operating device is an electromagnetic operating device that magnetises, in use, at least one of, and preferably both of, said first and second body parts.

Optionally at least one of, and preferably both of, said first and second body parts comprises one or more permanent magnet or is otherwise permanently magnetised.

In preferred embodiments the piezoelectric actuator of either one of said body parts is operable to engage with the other of said body parts to cause said body parts to move away from one another, typically causing the respective contact faces to disengage.

Typically the piezoelectric actuator of any one of said body parts is operable to engage with the contact face of other of said body parts to cause body parts to move away from one another, typically causing the respective contact faces to disengage.

Typically the piezoelectric actuator of any one of said body parts is operable to engage with the other of said body parts when in said closed state, and particularly when the respective contact faces are engaged.

Conveniently said at least one piezoelectric actuator is incorporated into, for example embedded in, or otherwise mounted on or carried by, the respective body part.

Typically said at least one piezoelectric actuator is expandable to move said at least one body part away from said other body part out of said closed state. Preferably, said at least one piezoelectric actuator has an expansion axis and is positioned with respect to the respective body part so that, upon expansion along said expansion axis, said at least one piezoelectric actuator expands outwardly from the respective body part. Said at least one piezoelectric actuator may be positioned so that an end of said at least one piezoelectric actuator is substantially level or level with the contact face of the respective body part, and is movable outwardly from said contact face upon expansion of said at least one piezoelectric actuator. Said end may be substantially level or level with said contact face when said at least one piezoelectric actuator is in an equilibrium or a contracted state.

In preferred embodiments a first piezoelectric actuator is coupled to said first body part and a second piezoelectric actuator is coupled to said second body part. Preferably the respective piezoelectric actuators are aligned for engagement with one another. Preferably the respective piezoelectric actuators are engagable with one another upon expansion of the or each piezoelectric actuator.

In preferred embodiments said first operating device comprises an electromagnetic operating device comprising at least one electromagnetic coil, the electromagnetic operating device being operable to move the or each body part by controlling the energisation of said at least one electromagnetic coil. Preferably, said electromagnetic operating device is configured to move the, or each, body part towards, and typically into engagement with, the other body part upon energisation of said at least one electromagnetic coil.

Said electromagnetic operating device may be configured to move the, or each, body part away from the other body part upon de-energisation of said at least one electromagnetic coil. Said at least one electromagnetic coil may be located around the, or each, of said body parts.

The or each of said body parts may be formed at least partly from ferromagnetic or magnetisable material.

In preferred embodiments both of said body parts are movable with respect to the other part, typically to allow said contact faces to move into or out of engagement with one another.

In preferred embodiments said body parts are coupled to a mechanical coupling mechanism for imparting movement of the, or each, body part to an object to be actuated. Said mechanical coupling mechanism may comprise at least one flexible structure connected to each of the body parts and spanning the interface of the contact surfaces. The or each flexible structure may be integrally formed with the body parts, preferably by a respective flexure bearing. A gap may be provided between the or each flexible structure and an outer face of the body parts through which at least one electromagnetic coil of said electromagnetic operating device is wound. Typically, the or each flexible structure curves outwardly with respect to the body parts. A respective flexible structure may be provided at opposite outer faces of the body parts.

Typically said first and second body parts are incorporated into a support structure that supports the body parts and controls said movement into and out of contact with one another.

A second aspect the invention provides an actuator comprising a switching device of the firs aspect of the invention, wherein said body parts are coupled to a mechanical coupling mechanism for imparting movement of the, or each, body part to an object to be actuated.

A third aspect of the invention provides a vacuum circuit breaker comprising the actuator of the third aspect of the invention coupled to a vacuum interrupter.

A fourth aspect of the invention provides a method of operating the switching device of the first aspect or an actuator of the third aspect, the method comprising:

causing said first operating device to move said at least one body part towards said other body part into said closed state, typically causing said contact faces to engage with each other; and causing said at least one piezoelectric actuator to move said at least one body part away from said other body part, typically causing said contact faces to disengage.

A fifth aspect of the invention provides a vacuum circuit breaker comprising: a housing providing a vacuum chamber; a vacuum interrupter having a movable first contact and a second contact, and an actuator coupled to the vacuum interrupter to move said first contact into and/or out of engagement with said second contact, wherein said vacuum interrupter and said actuator are located in said vacuum chamber, and wherein said vacuum chamber is partitioned into first and second sub-chambers by a partition, each of said first and second sub-chambers being in vacuum in use, and wherein said first and second contacts are located in said first sub-chamber and said actuator is located in said second sub-chamber. Said actuator is a piezoelectrically operated actuator. Said actuator is preferably a hybrid actuator comprising a first non-piezoelectric operating device and a second piezoelectric operating device. In preferred embodiment said actuator is the actuator of the second aspect of the invention.

Said partition may comprise a diaphragm. Said partition is preferably flexible, preferably in the direction of movement of said first contact and/or in the direction of movement of said actuator. Said partition is preferably non-resilient. Said partition may be comprised of multiple parts.

Preferably said partition provides a non-hermetic seal between the first and second sub-chambers.

Typically said partition includes at least one aperture, preferably at least one differential aperture.

Advantageously said partition is configured to support molecular flow between said first and second sub-chambers. Said at least one aperture may be dimensioned to support said molecular flow between said first and second sub-chambers.

Said partition may be configured to support Knudsen flow between said first and second sub chambers. Preferably said partition provides a Knudsen number of greater than 0.5. Preferably said at least one aperture is dimensioned to support Knudsen flow between said first and second sub-chambers.

In preferred embodiments said partition provides a barrier to the passage of molecules, in particular molecules emanating from said actuator during use, from said second chamber to said first chamber.

It will be understood that actuators embodying the invention are not limited to use in vacuum circuit breakers or with vacuum interrupters, and may for example be used in other switching devices.

Further advantageous aspects of the invention will be apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which like numerals are used to denote like parts and in which.

DETAILED DESCRIPTION OF THE DRAWINGS

Figure 1:
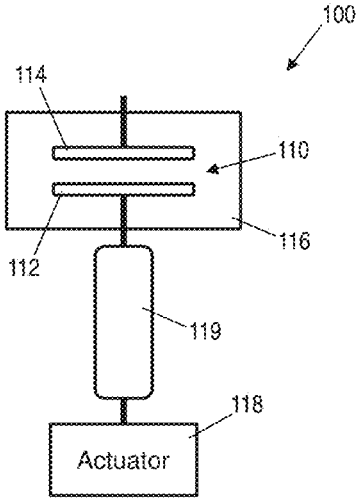
FIG. 1 is a schematic view of a first type of vacuum circuit breaker.
Figure 2:
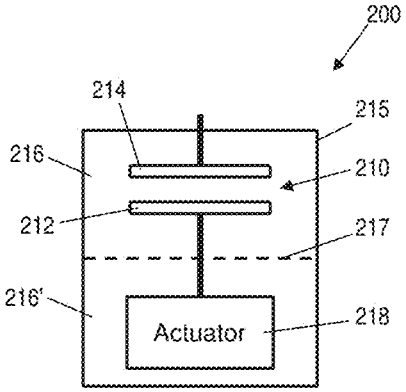
FIG. 2 is a schematic view of a second type of vacuum circuit breaker.

Referring now to FIGS. 1 and 2, there is shown, generally indicated as 100 and 200 an electrical circuit breaker device. The circuit breaker device 100, 200 is intended for use in breaking an AC electrical power supply (in particular at low voltages (LV)) and so may be referred to as an AC circuit breaker. The circuit breaker 100, 200 comprises a vacuum interrupter 110, 210 and as such may be referred to as a vacuum circuit breaker (VCB). The vacuum interrupter 110, 210 which may also be referred to as a vacuum switching device, comprises a movable electrical contact 112, 212 and a fixed electrical contact 114, 214 located in a vacuum chamber 116, 216, i.e. a chamber that is hermetically sealed and in vacuum, at least during use. The movable contact 112, 212 is movable between an open state, in which it is electrically and physically separate from the fixed contact 114, 214, and a closed state in which it makes electrical (and typically physical) contact with the second contact 114, 214. The open state of the movable contact 112, 212 corresponds to the open, or breaking, state of the vacuum interrupter 110, 210, and correspondingly of the circuit breaker 100, 200, in which it interrupts current flow in whatever circuit (not shown) it is part of. The closed state of the contact 112, 212 corresponds to the closed, or making, state of the vacuum interrupter 110, 210 and correspondingly of the circuit breaker 100, 200, in which current is able to flow between the contacts 112, 114 and 212, 214.

Movement of the contact 112, 212 between its open and closed states is effected by an actuator 118, 218. The VCB 100 of FIG. 1 is of a type in which the actuator 118 is located externally of the vacuum chamber 116 and is coupled to the movable contact 112 by a mechanical coupling mechanism 119, for example a circuit breaker bellows device. The VCB 200 of FIG. 2 is of a type in which the actuator 218 is located in the same housing 215 as the vacuum interrupter 210. In some embodiments, the actuator 218 is located within the vacuum chamber 216. The actuator 218 may be separated from the vacuum interrupter 210 by a partition 217. In any case, a coupling mechanism is typically provided between the actuator 218 and the movable contact 212 to allow the actuator 218 to move the contact 212. The mechanical coupling between the actuator 218 and the vacuum interrupter 210 may take any convenient form, for example comprising a flexible coupling member that extends across the inside of the housing 215 between the actuator 218 and the vacuum interrupter 210. For example the flexible member may be planar in form, e.g. comprising a sheet, plate or membrane, but it may alternatively take other forms, e.g. comprising a bar, strip or rod. Optionally, the flexible member is electrically conductive and electrically connects the movable contact 212 to an external circuit during use. In embodiments where the actuator 218 is located in a chamber separate from the vacuum chamber 216, the flexible member may separate the inside of the housing 215 into first and second chambers 216, 216', the vacuum interrupter 210 being in the first chamber 216, 216' and the actuator 218 being in the other, i.e. the flexible member may serve as the partition 217 or be otherwise combined with the partition 217. Both chambers 216, 216' may be in vacuum but there is typically a pressure differential between them. The ends of the flexible member 217 may be fixed to opposite sides of the housing 215 in any convenient manner.

The vacuum interrupter 110, 210, and therefore the VCB 100, 200, may operate in a normally closed state, i.e. with the contact 112, 212 in its closed state to allow current to flow between the contacts 112, 114 and 212, 214 and so to flow in any given circuit (not shown) in which the circuit breaker 100, 200 is installed during use. In such cases the VCB 100, 200 is configured to open automatically in response to detection of a fault condition, e.g. in response to detection of a current overload or short circuit, to protect the circuit into which it is incorporated during use. It achieves this by causing the actuator 118, 218 to move the first contact 112, 212 to its open state in response to detection of the fault. To this end the VCB 100, 200 includes, or is co-operable with, a controller (not shown) for effecting the open state upon detection of a fault. The controller typically comprises electrical and/or electronic circuitry that includes, or is connected to, one or more current sensors (not shown). The current sensor(s) are coupled in use to any convenient current conductor of the VCB 100, 200 or circuit to which the VCB is connected. Upon detection of current, more particularly prospective current, above a threshold level by the sensor(s), the controller causes the VCB to open. In preferred embodiments this is achieved by adjusting the voltage applied to the piezoelectric actuator 18. The controller does not typically open the contacts immediately upon detection of overcurrent, advantageously it monitors voltage and/or phase angle to determine a suitable opening instant, e.g. at the zero crossing point of the sinusoidal voltage signal (which typically has a frequency of 50-60 Hz).

In some embodiments, the VCB 100, 200 can be reset, i.e. closed, manually or semi-manually (e.g. by manual activation of a user control (not shown)) and/or automatically in response to the VCB 100, 200 detecting that the fault has gone, and/or after a threshold period of time has expired since activation. Circuit breakers that reset automatically are commonly known as reclosers.

Figure 3A:
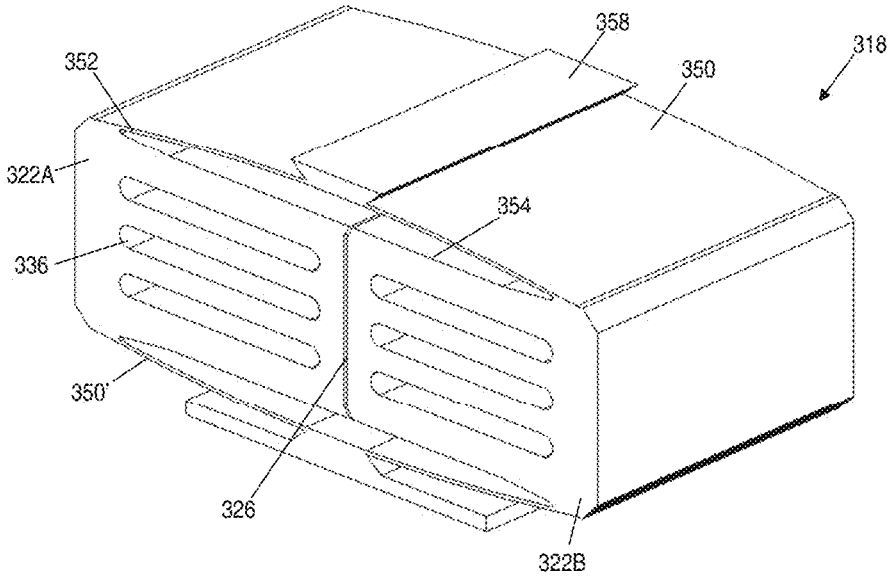
FIG. 3A is a perspective view of a hybrid actuator embodying one aspect of the invention.
Figure 3B:
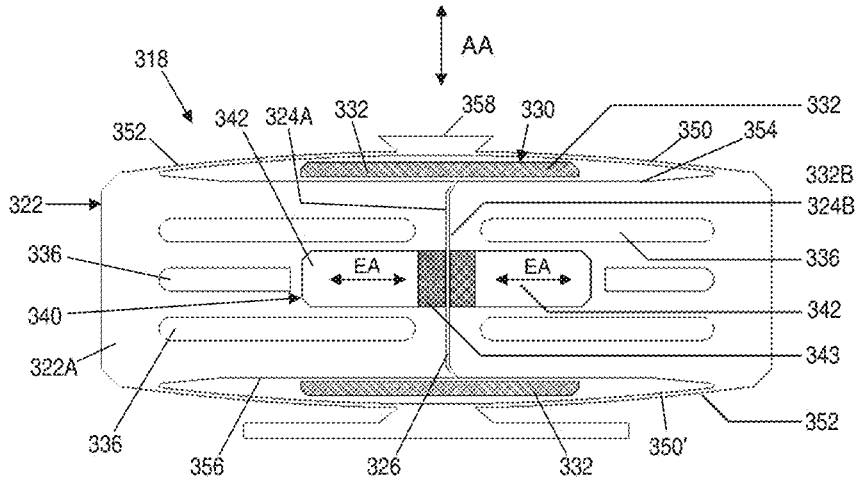
FIG. 3B is a side sectioned view of the hybrid actuator of FIG. 3A.
Figure 4:
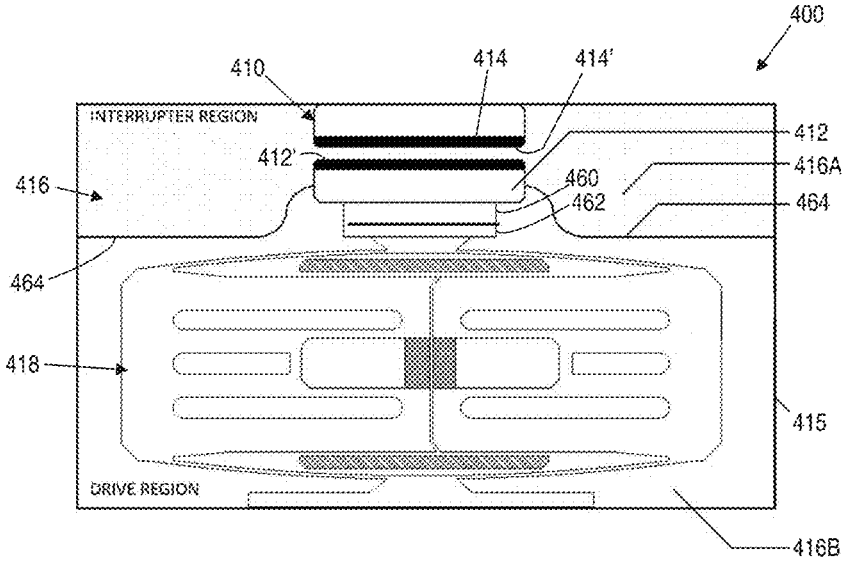
FIG. 4 is a side view of the hybrid actuator of FIGS. 3A and 3B incorporated into a vacuum circuit breaker.

Referring now to FIGS. 3 and 4, there is shown, generally indicated as 318 a hybrid actuator embodying one aspect of the invention and being suitable for use in a circuit breaker, especially a vacuum circuit breaker of any of the types described above. The preferred actuator 318 may be described as hybrid in that it comprises a combination of electromagnetic and piezoelectric operating devices, i.e. a magneto-piezo hybrid actuator. The hybrid magneto-piezo actuator may be said to comprise a hybrid magneto-piezo switching device, as is described in more detail hereinafter.

The actuator 318 comprises a body 322 having first and second parts 322A, 322B each having a contact face 324A, 324B. The first and second parts 322A, 322B are arranged so that contact faces 324A, 324B oppose one another. The first and second parts 322A, 322B are movable with respect to each other between a closed or contacting state (not illustrated), in which the contact faces 324A, 324B are in contact with one another, and a non-contacting state (as shown in FIGS. 3A and 3B) in which the body parts 322A, 322B are spaced apart to define a gap 326 between the contact faces 324A, 324B (in the contacting state the gap 326 is closed). In preferred embodiments, including the illustrated embodiment, both of the parts 322A, 322B are moveable, i.e. they both move towards each other when adopting the contacting state and away from each other when adopting the non-contacting state. In alternative embodiments (not illustrated) either one of the body parts may be fixed, the other of the body parts being movable towards and away from the fixed body part to adopt the contacting and non-contacting states. Typically, the, or each (as applicable) body part 322A, 322B moves substantially linearly. In alternative embodiments, a relatively small air gap may be present between the contact faces in the contacting state. In such cases the gap is sufficiently small that it allows the body parts 322A, 322B to be magnetically latched together.

The body parts 322A, 322B are formed from a ferromagnetic material, for example comprising iron, nickel or cobalt, or a suitable alloy of iron, nickel or cobalt.

The preferred actuator 318 includes an electromagnetic operating device 330 comprising one or more electromagnetic coil 332 (which may comprising one or more windings), and optionally a coil holder (not shown). The coil 332 is typically annular and is shown in FIG. 3B in cross section. The coil 332 is typically configured to form a solenoid. In the illustrated embodiment, the coil 332 is wrapped around the body 322. As such the body 322 passes through the coil 332, preferably being disposed substantially along the longitudinal axis of the coil 332. Preferably, the coil 332 is substantially centrally located around the body 322, typically overlapping with the contact faces 324A, 324B.

In alternative embodiments (not illustrated), the coil 332 may be embedded in either one or both of the body parts 322A, 322B. For example, an annular recess (not shown) may be formed in one or both of the contact faces 324A, 324B for receiving the coil 332. In such cases, the coil 332 may be carried by, typically fixed to, one of the body parts in the recess. Optionally, the relative dimensions of the recess and the coil are such that the coil projects from its recess, the other body part being provided with a recess for receiving the projecting portion of the coil when the body parts are in the contacting state.

In use, the coil 332 is energised by applying a voltage to it causing current to flow through the coil, the current creating an electromagnetic field around the coil. To this end the coil 332 is connected to any convenient electrical power supply (not shown). The coil 332 may be de-energised by reducing the current flowing through the coil 332 and/or by reversing the polarity of the voltage applied to the coil 332. When energised, the coil 332 acts as an electromagnet that causes the body parts 322A, 322B to move into the contacting state, i.e. creates a magnetic field and magnetic force that moves the body part(s). In preferred embodiments, when energised the coil 332 magnetises the body parts 322A, 322B to create latching residual magnetism between them, i.e. the body parts 322A, 322B are held in the contacting state by residual magnetism to create a magnetic latching effect. To this end the body parts 322A, 322B are formed at least partly from magnetisable, or ferromagnetic, material that is non-permanently magnetised but is susceptible of being magnetised by the electromagnetic field generated in use by the coil 332. In alternative embodiments, one or both of the body parts may be formed at least partly from permanently magnetised material.

In preferred embodiments, the body parts 322A, 322B serve as an electromagnetic core for the coil 332. In alternative embodiments where one of the body parts moves and the other is stationary, the movable part 322A may be regarded as an electromagnetic core for the coil 332, while non-movable part 322B may be regarded as a yoke.

The body parts 322A, 322B may be held in the contacting state by one or more of a variety of ways depending on the embodiment. For example, where one or both of the first or second body parts 322A, 322B comprises a permanent magnet, or is otherwise formed at least partly from magnetisable material, they may be held together by residual magnetism in the first and/or second body parts 322A, 322B. Alternatively, or in addition, the coil 332 may remain energised to maintain the contacting state by the electromagnetic force created by the electromagnetic field around the coil. In the illustrated embodiment, the coil 332 creates residual magnetism in the first and second parts 322A, 322B such that, when the coil 322 is subsequently de-energised, the first and second parts 322A, 322B are held together to maintain the contacting state by the latching effect of the residual magnetism.

The coil 332 may be operated to release the body parts 322A, 322B from the contacting state by controlling the voltage applied to the coil 322, and in particular by controlling the current flowing in the coil. For example, in embodiments where the coil 322 is energised to maintain the contacting state by electromagnetism, the body parts 322A, 322B may be released by de-energising the coil 332 (e.g. reducing the current flowing in the coil). In preferred embodiments, a suitable voltage may be applied to the coil 332 resulting in an electromagnetic field that has the effect of overcoming or cancelling any residual magnetism (or permanent magnetism as applicable) that is maintaining the latched contacting state. Conveniently, this is achieved by applying a voltage to the coil with opposite polarity to the voltage used to close the actuator 318.

Preferably, one or more slots 336 are formed in each body part 322A, 322B in order to suppress eddy currents during use. The slots may be filled with a suitably non-conductive material, e.g. an epoxy resin, or left unfilled.

The actuator 318 includes a piezoelectric operating device 340. In preferred embodiments, the piezoelectric operating device 340 is operable to move the body parts 322A, 322B from the contacting state to the non-contacting state. Typically this involves a pushing action, i.e. the piezoelectric operating device 340 acts to push the body parts 322A, 322B away from one another.

The piezoelectric operating device 340 comprises at least one piezoelectric actuator 342 (also known as a piezoelectric driver) coupled to the, or each, body part 322A, 322B and arranged to move the, or each, body part 322A, 322B relative to the other body part. In preferred embodiments, each body part 322A, 322B is provided with a respective piezoelectric actuator 342. In alternative embodiments (not illustrated), only one of the body parts 322A, 322B is provided with a piezoelectric actuator.

Typically, the, or each, piezoelectric actuator 342 comprises a stack of layers of piezoelectric material (the layers running along the $d_{33}$ axis). Any suitable conventional piezoelectric material may be used, for example lead zirconate titanate, e.g. PZT-5H Navy type VI or PIC 252 (PI). In preferred embodiments, the stack comprises one or more co-fired multilayer ceramics. The piezoelectric actuator 342 may for example be of a type that is operable in a bipolar or semi-bipolar manner. The piezoelectric actuator 342 expands along an expansion axis EA in response to the application of voltage of one polarity (e.g. a positive voltage in this example). Optionally, the piezoelectric actuator 342 may be of a type that contracts along the expansion axis EA in response to the application of voltage of the opposite polarity (e.g. a negative voltage in this example). Typically, the piezoelectric actuator 342 has an equilibrium length (in the direction of the axis EA) that it adopts in the absence of an applied voltage, increases this length in response to the application of voltage of the relevant polarity and returns to the equilibrium length in the absence of such voltage. The preferred piezoelectric actuator 342 contracts from the equilibrium length upon application of voltage of the opposite polarity and returns to the equilibrium length in the absence of such voltage.

Advantageously, the speed at which the piezoelectric actuator 342 returns to the equilibrium length can be increased by applying a voltage of the opposite polarity to that which caused it to expand or contract as applicable. For example, in the present example, application of a positive voltage causes the piezoelectric actuator 342 to expand along axis EA and, when in an expanded state, application of a negative polarity voltage causes the piezoelectric actuator 342 to contract more quickly than just the absence of a voltage. In any event, it will be understood that by adjusting the voltage applied to the piezoelectric actuator 342 it may be caused to expand and contract along the expansion axis EA, wherein the voltage adjustment may involve adjusting the magnitude and/or polarity of the applied voltage.

Electrodes (not shown) are provided for applying an electrical input signal to the, or each, piezoelectric actuator 342. Typically at least two electrodes are provided (at least one positive and one negative). The electrodes are connected to an electrical power supply (not shown), which may or may not be the same as the power supply for the coil 332. In any event the application of voltages to the piezoelectric actuator(s) 342 and the coil 332 is controlled separately, for example by a controller (not shown), programmed or otherwise configured to control the operation of the actuator 318 as described herein. For example the controller may comprise a microprocessor, microcontroller or other logic device incorporated into electrical circuitry for applying voltages to the coil 332 and the piezoelectric actuator(s) 342.

By way of example, in a typical embodiment, the, or each, piezoelectric actuator 342 may have a length (in the direction EA) of approximately 30 mm, a height of approximately 10 mm and a width of approximately 10 mm. Depending on the applied voltage, the piezoelectric actuator 342 may expand or contract along the EA axis by up to approximately 0.1% of its length. The applied voltage range may be for example −125 V to +500 V. Typically piezoelectric layer thickness may be approximately 250 μm. The piezoelectric actuator is typically substantially cuboid in shape but may take other shapes as suits the embodiment.

In preferred embodiments, the, or each, piezoelectric actuator 342 is coupled to the respective body part 332A, 332B such that expansion of the piezoelectric actuator 342 pushes the body parts 322A, 332B away from each other. Typically the arrangement is such that, upon expansion (e.g. from a contracted state to the equilibrium state, or from a contracted state to an expanded state, or from the equilibrium state depending on the embodiment), the piezoelectric actuator 342 engages with the contact face 324A, 324B of the other body part 322A, 322B to repel the body parts 322A, 332B away from each other. To this end it is preferred that the expansion axis EA is substantially parallel with the direction of movement of the respective body part 322A, 322B. Preferably, the piezoelectric actuator 342 is positioned such that one of its ends (in the direction of the expansion axis) is substantially flush or level, preferably exactly flush or level, with the respective contact face 324A, 324B of its respective body part 322A, 322B when the piezoelectric actuator 342 is in a contracted or equilibrium state (preferably in a contracted state in order to increase the stroke of the actuator 342). Preferably, the piezoelectric actuator 342 is embedded in the respective body part 322A, 322B, e.g. located in a recess formed in the respective body part 322A, 322B, preferably such that one end is located at the respective contact face 324A, 324B. Optionally, said one end of each piezoelectric actuator 342 is provided with a tip 343 formed from relatively hard material, e.g. high-hardness steel, in comparison with the piezoelectric material, to protect the piezoelectric material from the effects of impacts during use. Alternatively, the piezoelectric actuator 42 may be incorporated into, for example embedded in, or otherwise mounted on or carried by the respective body part in any convenient manner.

In preferred embodiments, a respective piezoelectric actuator 342 is provided in each body part 322A, 322B, the actuators 342 being aligned with each other so that, upon expansion, they engage with each other to repel the body parts 322A, 322B away from each other. Hence the combined stroke of the piezoelectric actuators 342 amplifies the repelling effect of the piezoelectric actuators 342.

In use, with the body parts 322A, 322B in the non-contacting state and with the piezoelectric actuators 342 in a relatively contracted state (e.g. in the equilibrium state or contracted with respective to the equilibrium state depending on the configuration of the embodiment), the body parts 322A, 322B may be brought together into the contacting state by energising the coil 332. Preferably, the arrangement of the piezoelectric actuators 342 is such that their ends do not prevent the contact faces 324A, 324B from engaging with each other in the contacting state. The body parts 322A, 322B may be maintained in the contacting state by maintaining energisation of the coil 332 or by residual magnetism after de-energisation of the coil 332. When it is desired to move the body parts 322A, 322B apart, the coil 332 is preferably de-energised, most preferably by reversing the polarity of the voltage applied to the coil 332. However, de-energisation of the coil 332 is not essential since, advantageously, separation of the body parts 322A, 322B is effected by the piezoelectric actuators 342. In particular, upon expansion of the piezoelectric actuators 342 in response to application of a suitable voltage signal, the piezoelectric actuators 342 push the body parts 322A, 322B apart, towards and, in some embodiments, into the non-contacting state. This separation of the body parts 322A, 322B causes any residual magnetism that was holding the parts 322A, 322B together to disappear and, as such, the body parts 322A, 322B do not move back to the contacting state until the next time the coil 332 is energised. In a preferred mode of use, upon establishing the contacting state, the coil 322 is de-energised by reducing the voltage applied to it. It is also preferred that, when separating the body parts 322A, 322B, in addition to expansion of the piezoelectric actuators 342, a reverse-polarity voltage is applied to the coil 332 to facilitate separation of the body parts 322A, 322B.

In some embodiments, one or more resilient biasing mechanism (for example one or more springs—not shown) may be provided to urge the body parts 322A, 322B apart and preferably into the non-contacting state. The resilient bias is overcome when the coil 332 is energised to bring the body parts 322A, 322B together, and (when applicable) by the subsequent residual magnetism that latches the body parts 322A, 322B together. Hence, when the piezoelectric actuators 342 are operated to separate the body parts 322A, 322B, the body parts are movable by the resilient bias.

An advantage of using the piezoelectric actuators 342 is the speed and precision at which their expansion and contraction can be controlled (in particular when moving the body parts 322A, 322B out of the contacting state in preferred embodiments) in comparison with the electromagnetic operating device 330. However, the amount by which each piezoelectric actuator 342 expands and contracts is relatively small for its size. In contrast, the electromagnetic operating device 330 supports a relatively large travel for the body parts 322A, 322B (in particular when moving from the non-contacting state to the contacting state in preferred embodiments) in comparison to that which could be effected by piezoelectric actuators alone. In addition, the electromagnetic operating device 330 is able to create a higher actuating force than the piezoelectric actuators 342. Hence, the hybrid actuator 318 is provided with a relatively large stroke with relatively high force, while being operable in a relatively fast and precise manner.

The body parts 322A, 322B are incorporated into a support structure that supports the body parts 322A, 322B and allows the relative movement between the contacting and non-contacting states. The relative position of the body parts 322A, 322B when they are at their furthest apart in the non-contacting state (which may correspond to a rest state of the body parts 322A, 322B) is typically determined by the configuration of the support structure into which the body parts 322A, 322B are incorporated and may differ from embodiment to embodiment. The support structure may take any suitable form, but in the illustrated example, the body parts 322A, 322B are incorporated into a support structure that includes a first flexible structure 350 connected to each of the body parts 322A, 322B and spanning the interface of the contact surfaces 324A, 324B. Conveniently, the flexible structure 350 is integrally formed with the body parts 322A, 322B, e.g. at a respective flexure bearing 352. Preferably, the flexible structure 350 extends across substantially the entire length of the actuator 318 in the direction of movement of the body parts 322A, 322B. The flexible structure 350 may be sheet-like in form, or may comprise one or more strips. The flexible structure 350 extends across an outer face 354 of the body parts 322A, 322B. Preferably a gap is provided between the flexible structure 350 and the outer face 354 through which the coil 332 is wound. The flexible structure 350 is conveniently formed from the same material as the body parts 322A, 322B. The flexible structure 350 is advantageously resiliently flexible. The flexible structure 350 preferably curves outwardly with respect to the body parts 322A, 322B. Preferably, a similar flexible structure 350' is provided at the opposite outer face 356 of the body parts 322A, 322B, the coil 322 being wound between the flexible structure 350 and the outer face 356.

In preferred embodiments, the flexible structures 350, 350' determine the positions of the body parts 322A, 322B in the non-contacting state, i.e. the rest position of each body part 322A, 322B. The flexible structures 350, 350' determine the extent of the travel of the body parts 322A, 322B between the contacting state and the non-contacting state. The resilience of the structures 350, 350' causes them to urge the body parts 322A, 322B apart and into the non-contacting state, i.e. the structures 350, 350' may serve as the resilient biasing devices described above.

The flexible structures 350, 350' serve as a mechanical coupling device between the body parts 322A, 322B and whatever item or structure (not shown in FIG. 3) the actuator 318 actuates in use. In this example, the flexible structures 350, 350' translate movement of the body parts 322A, 322B in the direction of the expansion axis EA into movement along a perpendicular actuation axis AA. The flexible structure 350 includes a coupling element 358 (for example an abutment or a connector) for coupling with the structure/item to be actuated. In the illustrated embodiment, the coupling element 358 moves upwards (as viewed in FIG. 3) along axis AA in response to movement of the body parts 322A, 322B towards each other, and moves downwards (as viewed in FIG. 3) along axis AA in response to movement of the body parts 322A, 322B away from each other. In alternative embodiments (not illustrated) the or each flexible structure 350, 350' may be configured so that the coupling element 358 moves downwards (as viewed in FIG. 3) along axis AA in response to movement of the body parts 322A, 322B towards each other, and moves upwards (as viewed in FIG. 3) along axis AA in response to movement of the body parts 322A, 322B away from each other. For example this may be achieved by configuring the or each flexible structure 350, 350' to bow inwardly towards the body 322A, 322B rather than outwardly as illustrated.

Advantageously, the flexible structures 350, 350' act as an amplifier by causing the actuation stroke of the hybrid actuator 318 (which in this example is the extent of travel of the coupling element 358) to be greater that the travel of the body parts 322A, 322B.

In preferred embodiments, the coil 332 generates a magnetic field that latches the contact faces 324A, 324B together as described by the Biot-Savart law. As the contact faces 324A, 324B close together, the flexible structures 350, 350'—which are themselves part of the magnetic circuit of the actuator—convert the relatively short horizontal (as viewed in FIG. 3) motion of the closing body parts 322A, 322B, into a relatively large vertical (as viewed in FIG. 3) motion. The preferred arc-shape of the flexible structures 350, 350' causes them to act as springs to damp the collision of the two contact faces during closing, and to provide an opening force to break the body parts apart; either when receiving a command to open the circuit, or during a power-loss condition.

The piezoelectric actuators 342 provide a substantial impulse triggered at a precise time to overcome the magnetic latching force and move the body parts 322A, 322B apart. This de-latching action preferably occurs simultaneously while a reverse bias is applied to the coil 322 to collapse the magnetic field. The deviation in time for the piezoelectric actuator(s) is much greater than the deviation for a reverse bias pulse in the coils alone. The improvement in accuracy obtained by using the piezoelectric actuators allows for better point-on-wave precision and lower latency, while the magnetic coil(s) 332 allow for a larger range of motion and therefore a bigger contact gap (improved dielectric strength).

It will be understood that hybrid actuators embodying the invention are not limited to use with the flexible structures 350, 350'. For example, hybrid actuators embodying the invention may be used with, or may include, other types of mechanical or electromechanical coupling device, e.g. a rod, lever and/or bellows device, or other arrangement for coupling the actuator to an item to be actuated. Moreover, such couplings need not be configured to impart actuation in a direction perpendicular to the direction of movement of the body parts 322A, 322B. For example, the coupling arrangement may be configured to impart actuation in a direction parallel with the direction of movement of the body parts. Furthermore, hybrid actuators embodying the invention may be incorporated into a support structure other than the one provided in this example by the flexible structures 350, 350', which support structure may determine the relative positions of the body parts and/or the permissible movement of the, or each, body parts as applicable. For example, the body parts may be coupled together by a stem that passes through each body part, at least one of the body parts being movable along the stem towards and away from the other body part. The support structure may for example hold one of the body parts in a fixed position and allow the other body part to move. In typical embodiments, the support structure allows one or both of the body parts to move by an amount that exceeds the displacement that can be effected by the piezoelectric actuator(s). Resilient biasing means may be provided to return the, or each, body part (as applicable) to a rest position.

In alternative embodiments, the or each piezoelectric actuator may be located behind the respective body part with respect to the other body part and be contractable to pull the respective body part away from the other body part. In such cases the piezoelectric actuator may be coupled between the respective body part and a support structure. In further alternative embodiments (not illustrated) one or more piezoelectric actuators may be provided to push, upon expansion, one or more of the body parts towards the other. To this end the piezoelectric actuator may be located behind the respective body part (with respect to the other body part) and configured to push against a support structure to move the respective body part towards the other body part.

In preferred embodiments, the or each piezoelectric actuator acts to push one body part with respect to another body part. This action may be by means of a direct coupling between the piezoelectric actuator and the other body part (or whatever object the piezoelectric actuator is intended to push away). For example in the illustrated example the piezoelectric actuator 342 of one body part 322A acts directly on the piezoelectric actuator 342 of the other body part 322B. Alternatively, there may be an indirect coupling between the piezoelectric actuator and the other body part (or whatever object the piezoelectric actuator is intended to push away). For example the or each piezoelectric actuator may act on a coupling member (e.g. a rod) that is provided between it and the other body part (or whatever object the piezoelectric actuator is intended to push away).

In preferred embodiments, the action of the piezoelectric actuator(s) 342 does not perform any mechanical unclamping or unlocking of the body parts 322A, 322B. Rather, the piezoelectric actuator(s) serve to break the magnetic latching effect that holds the body parts together. This is achieved by pushing the body parts far enough apart to break the magnetic latching effect between them. Once the magnetic latching effect is broken, the body parts 322A, 322B may be moved further apart into the non-contacting state, which movement is, in the present embodiment, effected by the flexible structures 350, 350', but could alternatively be caused by whatever other structure the body parts may be incorporated into in alternative embodiments.

In alternative embodiments, the piezoelectric actuator(s) 342 may be operated to hold the body parts 322A, 322B apart (i.e. the piezoelectric actuator(s) adopt a relatively expanded state to maintain an air gap between the body parts) and then operated, when required, to contract to allow the body parts to move together under whatever magnetic forces may be present depending on the embodiment (e.g. from a permanent magnetic field, an electromagnetic and/or a residual magnetic field as applicable).

In preferred embodiments, the magnetic latching effect is created by the electromagnetic operating device 330 as described above. In alternative embodiments, the electromagnetic operating device 330 may be omitted, in particular in embodiments where either or both the body parts 332A, 332B comprise (permanent) magnets with respective magnetic poles arranged to magnetically latch the body parts 322A, 322B together when the body parts are close enough together. As such, the magnetic body parts 322A, 322B magnetically hold the body parts 322A, 322B in the contact state. When it is desired to move the body parts 322A, 322B to the non-contacting state, the magnetic latching effect can be broken by the piezoelectric actuators 342 in the same manner described above. In such embodiments, another operating device (not shown) may be provided for moving the body parts 322A, 322B towards one another in order to create the magnetic latching effect. The other operating device may take any suitable conventional form (typically a non-piezoelectric form), typically comprising one or more actuating devices e.g. an electric actuator(s), mechanical actuator(s) or electro-mechanical actuator(s) or any combination thereof. Such embodiments may still be referred to as hybrid actuators since they employ more than one type of actuator to operate, in particular a piezoelectric actuator to move the body parts apart and another type to move the body parts together.

While embodiments of the invention are described herein in the context of actuators, it will be understood that the invention is not limited to actuators. In this connection, the hybrid actuator 318 may be said to comprise a hybrid magneto-piezo switching device which, in the illustrated embodiment, comprises the movable body parts 322A, 322B, the piezoelectric operating device 340 and the electromagnetic operating device 330 (or alternative operating device in cases where the electromagnetic operating device is omitted). The hybrid magneto-piezo switching device need not necessarily be used as part of an actuator. For example it may alternatively be used in a magnetic circuit (not illustrated), e.g. as an adjustable reluctance device or for selectively creating an air gap in the circuit, or as a magnetic latch device. Alternatively still, the hybrid magneto-piezo switching device may be used in an electrical switch. The contacting state described herein may be said to correspond to the closed state of the hybrid magneto-piezo switching device. In typical embodiments, the respective contact faces of the body parts 322A, 322B engage with one another in the closed (or contact) state and are pushed apart by expansion of the piezoelectric actuator(s). However, in some embodiments there may be a gap between the contact faces in the closed state.

Hybrid actuators embodying the invention are suitable for use in vacuum circuit breakers. In particular the hybrid actuator may be coupled to a vacuum interrupter and be operable to open and close the contacts of the interrupter.

FIG. 4 shows an embodiment of a vacuum circuit breaker (VCB) 400 embodying another aspect of the invention. The VCB 400 comprises a vacuum interrupter 410 and an actuator 418. In this example, the actuator 418 is the same as the actuator 318 described above with reference to FIGS. 3A and 3B. However, in alternative embodiments (not illustrated) the actuator 418 may take other forms, for example a conventional electromagnetic actuator or a conventional piezoelectric amplifier, especially an amplified piezoelectric amplifier.

The vacuum interrupter 410, or vacuum switching device, comprises a movable electrical contact 412 a fixed electrical contact 414 located in a vacuum chamber 416, i.e. a chamber that is hermetically sealed and in vacuum, at least during use. The movable contact 412 is movable between an open state (as illustrated), in which it is electrically and physically separate from the fixed contact 414, and a closed state in which it makes electrical and physical contact with the fixed contact 414. Each contact 412, 414 has a contact surface 412', 414' which are disposed in opposition to each other (as illustrated) in the open state and which engage with each other in the closed state. The open state corresponds to the open, or breaking, state of the vacuum interrupter 410 and correspondingly of the circuit breaker 400, in which it interrupts current flow in whatever circuit (not shown) it is part of. The closed state corresponds to the closed, or making, state of the vacuum interrupter 410, and correspondingly of the circuit breaker 400, in which current is able to flow between the contacts 412, 414.

Movement of the contact 412 between its open and closed states is effected by the actuator 418. In typical embodiments, the actuator 418 moves the contact 412 into and out of engagement with the contact 414 as required. In alternative embodiments, the actuator may only move the contact into or out of engagement with the other contact. For example the actuator may be operable to separate the contacts, and the contacts may be closed together manually, or vice versa.

The VCB 400 is of a type in which the actuator 418 is located in the same housing 415 as the vacuum interrupter 410. The housing 415 may be formed from any suitable material. The actuator 418 is located in the vacuum chamber 416 and is coupled to the movable contact 412. The mechanical coupling between the actuator 418 and the vacuum interrupter 410 may take any convenient form. In the illustrated embodiment, the coupling comprises a flexible, electrically conductive structure 460 and an electrical, and preferably also thermal, isolator 462 that electrically, and preferably also thermally, isolates the actuator 418 from the flexible structure 460. The isolator 462 couples the actuator 418 to the flexible structure 460, and may for example comprise one or more blocks or layers of electrical and/or thermally isolating material(s). In this example the coupling element 358 of the actuator 418 is coupled to the isolator 462, e.g. by abutment or by adhesive.

The flexible structure 460 (which is shown in end view in FIG. 4) extends across the inside of the housing 415 between the actuator 418 and the vacuum interrupter 410. The illustrated flexible structure 460 takes the form of a strip of electrically conductive material, but it may alternatively take other forms, e.g. comprising a bar, rod, sheet, plate or membrane. The ends of the flexible structure 460 may be fixed to opposite sides of the housing 415 in any convenient manner.

The actuator 418 is coupled to the flexible structure 460 such that operation of the actuator 418 causes the flexible structure 460 to flex upwards and downwards as viewed in FIG. 4. Preferably the flexible structure 460 is non-resilient, e.g. has substantially no resilience or a low resilience, to provide little or no resistance to being flexed. This may be achieved by appropriate selection of the material from which the flexible structure 460 is made and/or its thickness and/or its shape. The contact 412 is coupled to the flexible structure 460 such that its flexing is transmitted into corresponding movement of the contact 412 towards and away from the fixed contact 414.

The flexible structure 460 is electrically connected to the movable contact 412 and to a terminal (not shown) of the VCB 400 and serves as an electrical conductor for carrying electrical current between the contact 412 and the respective VCB terminal during use (and therefore to an external circuit in which the VCB is incorporated for protection). To this end, the flexible structure 460 is formed wholly or partly from an electrically conductive material, or may include an electrical conductor. For example, the flexible structure 460 may be a metal, e.g. copper, strip.

While there are advantages in including the actuator 418 in the same chamber 416 as the vacuum interrupter 410, e.g. miniaturisation, in arriving at this aspect of the present invention a problem has been identified, namely outgassing from components of the actuator 418 (e.g. coils or piezoelectric coatings) or from the mechanical coupling can have a detrimental affect on the performance of the vacuum interrupter 410. For example outgassing can cause a change, in particular an increase, in pressure in the vacuum chamber and/or results in the presence of molecules in the vacuum chamber both of which can lead to a degradation in performance of the interrupter 410, e.g. by reducing dielectric strength.

To address this problem, a partition 464 is provided in the housing 415 to partition the vacuum chamber 416 into first and second sub-chambers 416A, 416B, the voltage interrupter 410 being in the first sub-chamber 416A and the actuator 418 being in the second sub-chamber 416B. The partition 464 serves as a barrier for preventing molecules from passing from the second sub-chamber 416B to the first sub-chamber 416A. In preferred embodiments, the partition 464 comprises a diaphragm or other sheet-like structure. However the partition 464 may comprise any other suitable structure and may comprise one or more parts. While the partition 464 separates the sub-chambers 416A, 416B from each other, it does not have to provide a hermetic seal between the sub-chambers 416A, 416B, i.e. does not have to hermetically seal the sub-chambers from each other. Moreover, it is preferred that the partition 464 does not hermetically seal the sub-chambers from each other. Therefore one or more apertures (not shown) or other formations or imperfections (not shown) may be present in the partition 464 and/or at the interfaces between the partition 464 and any component to which it is fixed, e.g. surfaces of the chamber 416 and/or the mechanical coupling between the actuator 418 and the contact 412 and/or the contact 412, as applicable. Any aperture(s), including those provided by formation(s) such as channels or gaps, in or around the partition 464 are preferably of a type known as a "differential aperture", meaning that they are sufficiently small to at least restrict and ideally prevent molecules from passing from the second sub-chamber 416B to the first sub-chamber 416A. To this end, the configuration of the partition 464 and its interfaces is such that any apertures provide a high Knudsen number (Kn), preferably Kn>0.5.

In the illustrated embodiment, the partition 464 (in the preferred form of a diaphragm) extends across the inside of the chamber 416, covering the whole cross sectional area of the chamber 416 (subject to any apertures/formations described above) and is fixed, e.g. sealed non-hermetically or otherwise fixed non-hermetically, to the wall(s) of the chamber 416 (and any other component(s) of the VCB that may pass through the partition 464) in any convenient manner, for example by brazing e.g. vacuum brazing. In this example, the partition 464 is also fixed, non-hermetically, to the movable contact 412. In particular the partition 464 surrounds the contact 412 and is fixed to the contact 412 around its periphery. The diaphragm is flexible to accommodate movement of the contact 412.

In the illustrated embodiment, the actuator 418 and mechanical coupling between the actuator 410 and the movable contact 412 (i.e. the flexible structure 460 and the isolator 462 in this example) are located in the second sub-chamber 416B while the vacuum interrupter 410 is located in the first sub-chamber 416A. In this example, a rear part of the body of contact 412 is in the second sub-chamber 416B but the active parts of the vacuum interrupter, in particular the inter-engagable contact surfaces of the contacts, are in the first sub-chamber 416A.

In alternative embodiments the location of the partition 464 may be such that the segregation of components between the sub-chambers is different to that illustrated in FIG. 4, for example the partition may intersect the mechanical coupling between the actuator 410 and the movable contact 412 so that a part of the mechanical coupling is located in the first sub-chamber 416A. It is preferred however that substantially all of the mechanical coupling is in the second sub-chamber 416B, i.e. isolated from the contacts of the vacuum interrupter 410. In any event at least the contacts 412, 414, and more particularly the inter-engagable contact surfaces of the contacts 412, 414, are located in the first sub-chamber 416A to be isolated from the affects of outgassing caused by the other components. In practice it may be said that the vacuum interrupter 410 is located in first sub-chamber 416A (even if non-active parts of it may be exposed to the second sub-chamber). The partition 464 is sealed non-hermetically or otherwise fixed non-hermetically to any component that it intersects.

Instead of comprising a diaphragm, the partition 464 may comprise any other suitable structure(s), for example a linkage or assembly of plates (not illustrated). Any aperture(s), including formation(s) such as channels or gaps, in or around the structures(s) are preferably of the "differential aperture" type. In addition, the partition 464 is configured, i.e. is flexible and/or movable, to accommodate the movement caused by the actuator 418. In preferred embodiments the partition 464 may be said to comprise circuit breaker bellows.

In preferred embodiments, the partition or diaphragm 464 comprises a metallic foil, preferably a low mechanical resistance metallic foil. In this context low mechanical resistance may for example meaning exhibiting a K-value of 50 n/mm or less. The partition 464 is preferably non-resilient. By way of example the partition 464 may be made from aluminium-silicon copper, copper-silver, silver or a nickel alloy. The diaphragm, or other structure used to provide the partition, may be separate from or combined with the flexible conductor structure 460. The partition 464 may contain apertures, e.g. holes, channels, gaps and or defects providing a high Knudsen number, for example a Knudsen number of 0.5 or more, i.e. a hermetic seal is not required and in preferred embodiments is not desired. Without a hermetic seal the diaphragm, or other partitioning structure, has a low mass, low mechanical resistance and is simple to manufacture. Such factors dramatically improve yield.

During use, each of the sub-chambers 416A, 416B is in vacuum, i.e. held at a vacuum pressure, preferably at least Medium Vacuum pressure, more preferably at least high vacuum pressure (typically pressures in the order of $10^{-3}$ mBar or lower). Initially at least, each sub-chamber 416A, 416B may be at the same or substantially the same vacuum level. During use, as a result of outgassing from the components in the second sub-chamber 416B a pressure differential between the sub-chambers 416A, 416B may arise (the pressure in the second sub-chamber may increase). However, the pressure differential is relatively small. For example, the sub-chambers 416A, 416B may be initially at the same pressure (e.g. ~$10^{-6}$ mBar), but continuous outgassing from components in the second sub-chamber 416B such as coils or piezoelectric coatings causes a differential rate of rise in pressure between the two sub-chambers over time. Increased pressure caused by the outgassing would, if the vacuum interrupter were exposed to it, lead to degradation in performance in the interrupter by reducing dielectric strength. The segregation provided by the partition 464 prevents, or substantially prevents this.

A standard vacuum interrupter (VI) typically has bellows to maintain ultra-high vacuum (UHV) pressures, and such bellows must contend with substantial pressure gradients from atmosphere to UHV. In contrast, the partition 464 provided in preferred embodiments of the present invention supports a molecular flow regime (as opposed to a laminar or viscous flow regime). The molecular flow may be referred to as Knudsen flow. Knudsen flow occurs where a characteristic length (or other relevant dimension e.g. the width of an aperture or channel) of the flow space (which in this case would be provided by the aperture(s) in the partition 464) is of the same or a smaller order of magnitude than the mean free path of the molecules (in this case any molecules present in the sub-chamber 416B as a result of outgassing from one or more components of the actuator 418). In this case it may be said that the partition 464 provides a high Knudsen number. The Knudsen number (Kn) is the ratio of the mean free path ($\lambda$) of the molecules to the characteristic dimension (d):$Kn=\lambda/d$. In preferred embodiments the partition 464 provides a Knudsen number greater than 0.5. Alternatively Knudsen number may be greater than or equal to 1. In any event, as a result there is almost no pressure differential between the two sub-chambers (e.g. ~$10^{-6}$ mBar in the first chamber 416A and ~$10^{-3}$ mBar in the second sub-chamber). Any aperture(s) in the partition 464 are very small (typically less than 1 mm).

The mean free path ($\lambda$) is the average distance a gas molecule can travel before colliding with another gas molecule and is a function of the vacuum pressure inside the vessel. In the high-vacuum regime in which the circuit breaker operates the mean free path is typically on the order of 1 km.

The low pressure gradient between the sub-chambers 416A, 416B means there is almost no force on the diaphragm, or other partition structure, allowing it to be thin, lightweight and simple to manufacture. These mechanical factures in turn mean that the diaphragm, or other partition structure, does not interfere with the motion of the actuator 418 and contact 412. Material and geometric variations which are inevitable in the construction of bellows would lead to appreciable deviations in the predictability of the mechanics—which would affect point-on-wave performance thereby decreasing the interruption capacity, success rate and/or lifetime.

The invention is not limited to the embodiment(s) described herein but can be amended or modified without departing from the scope of the present invention.

The invention claimed is:

1. A switching device comprising:

a first and a second body part;

a first operating device coupled to said at least one body part and being operable to move said first and second body parts into a closed state; and a first piezoelectric actuator coupled to said first body part, and a second piezoelectric actuator coupled to said second body part, said first and second piezoelectric actuators being operable to move said first and second body parts away from each other out of said closed state.

2. The switching device of claim 1, wherein said first body part has a contact face and the second body part has a contact face, the contact face of the first body part and the contact face of the second body part being engaged with one another in said closed state, said first and second piezoelectric actuators being operable to move said first and second body parts to cause the contact faces to disengage.

3. The switching device of claim 2, wherein said first operating device is an electromagnetic operating device that magnetises, in use, at least one from the group consisting of said first and second body parts.

4. The switching device of claim 2, wherein at least one from the group consisting of said first and second body parts comprises one or more permanent magnet or is otherwise permanently magnetised.

5. The switching device of claim 2, wherein the first and second piezoelectric actuators are operable to engage with the contact face of the second and first body part, respectively, to cause the first and second body parts to move away from one another.

6. The switching device of claim 2, wherein said first piezoelectric actuator is incorporated into the contact face of the first body part, and the second piezoelectric actuator is incorporated into the contact face of the second body part.

7. The switching device of claim 2, wherein each of the first and second piezoelectric actuators has an expansion axis and is positioned with respect to the first and the second body part, respectively, so that, upon expansion along said expansion axis, the first and second piezoelectric actuators expand outwardly from the first and second body part, respectively, and where, said first and second piezoelectric actuators are positioned so that a respective end of the first and second piezoelectric actuator is substantially level or level with the contact face of the first and second body part, respectively, and is movable outwardly from said contact face upon expansion of the first and second body part.

8. The switching device of claim 2, wherein said first and second body parts are coupled to a mechanical coupling mechanism for imparting movement of the first and second body parts to an object to be actuated, and where said mechanical coupling mechanism comprises at least one flexible structure connected to each of said first and second body parts and spanning an interface of the contact faces.

9. The switching device of claim 8, wherein a gap is provided between said at least one flexible structure and an outer face of the first and second body parts through which at least one electromagnetic coil of said electromagnetic operating device is wound.

10. The switching device of claim 1, wherein said first and second body parts are magnetised or magnetisable to create a magnetic latching effect to hold the first and second body parts in said closed state, and where said first and second piezoelectric actuators are operable to move the first and second body parts away from each other to break said magnetic latching effect.

11. The switching device of claim 1, wherein the first and second piezoelectric actuators are aligned for engagement with one another.

12. The switching device of claim 1, wherein said first operating device comprises an electromagnetic operating device comprising at least one electromagnetic coil, the electromagnetic operating device being operable to move at least one from the group consisting of said first and second body parts by controlling energization of said at least one electromagnetic coil.

13. The switching device of claim 12, wherein said electromagnetic operating device is configured to move the first and second body parts into said closed state upon energization of said at least one electromagnetic coil.

14. The switching device of any preceding claim 1, wherein said first and second body parts are incorporated into a support structure that supports the first and second body parts and controls movement into and out of the closed state.

15. The switching device of claim 1, incorporated into an actuator of a vacuum circuit breaker, the actuator being coupled to a vacuum interrupter, where said first and second body parts are coupled to a mechanical coupling mechanism for imparting movement of the first and second body parts to a movable contact of said vacuum interrupter.

* * * * *